US007712732B2

(12) United States Patent
Horii et al.

(10) Patent No.: US 7,712,732 B2
(45) Date of Patent: May 11, 2010

(54) SHEET-FOLDING APPARATUS AND IMAGE-FORMING SYSTEM EQUIPPED WITH THE SAME

(75) Inventors: Toshihiro Horii, Kofu (JP); Hiroki Imazu, Kofu (JP); Hiroyuki Yamada, Nakakoma-gun (JP)

(73) Assignee: Nisca Corporation, Minamikoma-gun (JP)

( * ) Notice: Subject to any disclaimer, the term of this patent is extended or adjusted under 35 U.S.C. 154(b) by 138 days.

(21) Appl. No.: 11/754,388

(22) Filed: May 29, 2007

(65) Prior Publication Data

US 2007/0290427 A1 Dec. 20, 2007

(30) Foreign Application Priority Data

May 31, 2006 (JP) ..... 2006-152680

(51) Int. Cl.
*B41L 43/00* (2006.01)
*B41L 1/32* (2006.01)
*B65H 33/04* (2006.01)
*B65H 39/00* (2006.01)

(52) U.S. Cl. ..... 270/32; 270/39.06; 270/39.01; 270/39.07; 270/58.07

(58) Field of Classification Search ..... 270/32, 270/39.01, 39.06, 39.07, 58.07
See application file for complete search history.

(56) References Cited

U.S. PATENT DOCUMENTS 5,836,576 A * 11/1998 Ebner et al. ..... 270/58.02
6,357,736 B1 * 3/2002 Kubota et al. ..... 270/58.08
7,152,856 B2 * 12/2006 Kamiya et al. ..... 270/37
7,281,707 B2 * 10/2007 Moriyama et al. ..... 270/58.04
7,281,708 B2 * 10/2007 Murata et al. ..... 270/58.12
2006/0012098 A1 * 1/2006 Kaneko ..... 270/37
2007/0045919 A1 * 3/2007 Hayashi ..... 270/32

FOREIGN PATENT DOCUMENTS

JP 2006-076776 A 3/2006
JP 2006-076777 A 3/2006
JP 2006-076778 A 3/2006
JP 2006-076779 A 3/2006
JP 2006076776 A * 3/2006

* cited by examiner

*Primary Examiner*—Gene Crawford
*Assistant Examiner*—Yolanda Cumbess
(74) *Attorney, Agent, or Firm*—Judge Patent Associates

(57) ABSTRACT

Sheets after having been sequentially folding-processed are stowed neatly without becoming dog-eared, wrinkled, etc. in the course of being transported to a stacker. A folding process unit folds sequentially fed copy paper or other sheets, and a sheet stacking unit loads/stows sheets from the folding unit. A conveyance device conveying one folding-processed sheet at a time is furnished between the folding unit and the sheet stacking unit. The conveyance device includes a first, upstream conveyance unit conveying sheets from the folding process unit in a direction approximately orthogonal to the sheets' crease(s), and a second, downstream conveyance unit conveying sheets in the orientation of the crease(s). The second conveyance unit is configured with a tray member where sheets are supported one at a time, and is configured so as to sequentially deliver each sheet to the sheet stacking unit along the tray member in the orientation of the crease(s).

15 Claims, 10 Drawing Sheets

SHEET-FOLDING APPARATUS AND IMAGE-FORMING SYSTEM EQUIPPED WITH THE SAME

BACKGROUND OF THE INVENTION

1. Technical Field

2. Description of the Related Art

The present invention—involving sheet-folding apparatuses and sheet-folding-apparatus-equipped imaging systems that fold sheets sequentially delivered from an image-forming or like apparatus—relates to improvements in mechanisms that automatically fold sheets in half or in thirds, and that securely stow the sheets in a stacker.

Commonly known among this kind of sheet-folding apparatus are in general machines that fold in half or in thirds sheets delivered from an imaging or like apparatus, and deliver the folded sheets to and stow them in a stacker. Therein, for the folding style various techniques, such as Z-folding or gate-folding, are adopted depending on the application, such as mailing or filing. For example, Japanese Unexamined Pat. App. Pub. No. 2004-352419 discloses an apparatus in which provided within a conveyance path is a plurality of folding roller mechanisms that fold sheets by nipping them between the rollers in a process that takes over the conveyance of sheets from an imaging apparatus, and that stows the gate-, Z-, or otherwise-folded sheets in a stacker, or that binds the sheets together in a binding apparatus disposed downstream of the folding mechanisms.

In Japanese Unexamined Pat. App. Pub. No. 2004-189413 as well, a similar apparatus is proposed. Either of these machines folds sheets in half or thirds, in creases that are orthogonal to the direction of sheet conveyance. Also, Japanese Unexamined Pat. App. Pub. No. H06-016317 discloses an apparatus in which after sheets from an imaging apparatus are folded by folding rollers, a predetermined number of copies of the sheets drop into a stack on a tray, and after being stapled, the sheets are conveyed out in the orthogonal direction (creasing direction).

In folding with folding rollers sheets sequentially delivered from an imaging apparatus and loading/stowing them onto a downstream stacker, as described above conventionally adopted have been either a method whereby the folded sheets are conveyed in a direction orthogonal to the crease orientation and stowed, as with the above-cited Pat. App. Pub. Nos. 2004-352419 and 2004-189413, or a method whereby after having been bound together the folded sheets are conveyed in the orientation of the crease and stowed in the stacker, as with Pat. App. Pub. No. H06-016317. Consequently, delivering in an orientation orthogonal to the crease orientation in loading/stowing on the stacker, as disclosed in Pat. App. Pubs. Nos. 2004-352419 and 2004-189413, can cause a folded sheet to advance into the fold of a sheet that has already been stacked, giving rise to a sheet jam. FIG. 10 illustrates this, wherein in discharging a sheet from folding rollers into a stacking tray, the sheet S" enters, as the arrow indicates, into the fold of already stacked sheet S'.

Therefore, conventionally a structure has been adopted that establishes the discharge outlet and stacking tray at different levels so that from the discharge outlet the sheet S" falls on top of the uppermost sheet S'already stacked in the tray. This has meant that in the stacking tray sheets can get stowed in disarray, leading to the trouble of sheets scattering inside the apparatus, which compels the user to realign the sheets (bundles) stowed in the stacking tray after having taken them out of the tray. In the same way, with the structure in earlier cited Pat. App. Pub. No. H06-016317, folded sheets are dropped from the folding rollers directly into and stacked on a processing tray, and after sheets collated into a bundle on the processing tray are stapled, the sheet bundle is from an intermediary tray transported in the orientation of the crease and stowed in the stacking tray. Inasmuch as an intermediary tray is therefore disposed directly beneath the folding rollers, the apparatus layout is made complex; moreover, this intermediary tray carries with it the earlier described problem explained with FIG. 10.

BRIEF SUMMARY OF THE INVENTION

An issue for the present invention is to make available a sheet-folding apparatus that, after folding with a folding roller mechanism sequentially supplied sheets, enables neat stowage of the sheets into a stacker.

A further issue for the present invention is to make available a sheet-folding apparatus of a simple structure that in delivering folded sheets to the stacker, without dog-earing, wrinkling, or otherwise impairing the sheets, enables stacking the sheets neatly.

The present invention employs the following configuration to solve the aforementioned problems. A folding unit that folds sequentially fed sheets and other sheets, and a sheet stacking unit that stores sheets fed from the folding unit are provided. A conveyance means that conveys one folded sheet at a time is disposed between the folding unit and the sheet stacking unit. The conveyance means is composed of a first conveyance means disposed upstream to convey a sheet from the folding unit in a direction perpendicular to the fold in the sheet, and a second conveyance means disposed downstream that conveys the sheet in the direction of the fold.

The second conveyance means is composed of a tray member that stacks sheets from the first conveyance means, and a shift member that moves sheets on the tray member in the direction of the fold in the sheet. Because the sheet is fed from the folding unit by folding rollers along its folded seam, the crease in the sheet is securely pressed therebetween the rollers. The second conveyance means moves the folded sheet along the tray member in the direction of the fold in the sheet into the sheet stacker unit so the sheet does not slip into the fold of previously stacked sheets, and is neatly stacked.

Also, the first conveyance means is composed of a pair of rollers that nippingly convey sheets. The shift member is configured to touch a trailing edge of the sheet to shift the sheet into the sheet stacking unit. The folding roller mechanism securely folds the folded sheet along its fold using the pair of rollers. The sheet, now securely folded, is shifted securely into the stacker by the shift member without boxing its ears or wrinkling the sheet, and enabling the sheet to be securely stored.

Furthermore, the length of the tray member in the conveyance direction is shorter than the length of at least the maximum sized sheet in the conveyance direction. Therefore, when the leading edge of the sheet is moved over the stacker, there is no problem of it pushing on the trailing edge of previously stacked sheets which causes paper jams. This also makes it possible for a compact apparatus.

The sheet stacking unit is composed of a stacker that stacks sheets fed from the conveyance means. It has a first level-split formed between the first conveyance means and the tray member where sheets drop, and a second level-split formed between the tray member and stacker where sheets fall into the stacker for storage. In addition to enabling a configuration where the tray length is shorter than the sheet size, the leading edge of the sheet at the first level-split falls onto the top of the trailing edge of the an uppermost sheet stacked in the stacker.

Because the sheet is pushed along the tray member into the stacker, it is neatly stacked without jamming.

A discharge path that conveys the sheet from the folding unit further downstream is linked downstream of the first conveyance means. A path switching member that selectively guides the sheet from the first conveyance means into the discharge path or the tray member is disposed in the discharge path. A guide member is provided above the tray member to guide a sheet from the path switching member to the tray member. The guide member is configured to move between a retracted position where it does not hinder the conveyance of the sheet in the discharge path and a guiding position to guide the sheet to the tray member.

A slit is formed in the tray member along the direction of the fold in the sheets. The shift member is mated to the slit. The guide member guides the sheet into the top of the tray member without the leading edge of the sheet getting caught in the slit when it advances into the tray member.

The shift member is equipped on an endless belt, for example, to circulate around the front and back sides of the tray member along the slit formed in the tray member in the direction of the folds in the sheets. The shift member is configured to pivot when it comes into contact with sheets on the stacker in the process to circulate around the front and back sides of the tray member.

The image forming system of the present invention is provided an image-forming apparatus that forms an image on the sheet, a folding apparatus that folds the sheet conveyed from the image-forming apparatus, and a finisher that stacks sheets conveyed from the folding apparatus, and binds the sheets together to form a sheet bundle. A discharge path that conveys sheets from the image-forming apparatus to the finisher, and a folding process path that folds sheets from the image-forming apparatus are provided in the sheet folding apparatus. The finisher configuration is described above. An inserter is provided in the image-forming system. The inserter is equipped with a tray that holds sheets, and separating means that separates sheets on the tray into single sheets. The system is configured to selectively feed a sheet on the tray or a sheet from the image-forming apparatus to the folding process path.

Sheets from the folding unit are conveyed in a direction perpendicular to the fold in the sheet by the first conveyance means, and are supported on the tray means. The sheets on the tray are conveyed by the second conveyance means in a direction along the fold in the sheets and then stored in the stacker. Therefore, the sheet fed from the folding unit by the folding rollers or the like are securely folded by the first conveyance means, and are shifted into the stacker along the fold in the sheet by the second conveyance means. In the process to convey the folded sheets, they are neither wrinkled nor do the experience boxed ears. When conveyed into the stacker, they do not slip into the fold of previously stacked sheets, so the problem of paper jams is alleviated. The sheets fed along the tray member are securely conveyed into the stacker, and are neatly stacked at the same time.

Furthermore, because the sheet falls into the tray member, and the tray member is configured to be shorter than the length of at least the maximum sheet size, there is no problem of the sheets previously stacked in the stacker being pushed out by the sheet advancing into the stacker.

BRIEF DESCRIPTION OF THE SEVERAL VIEWS OF THE DRAWINGS

FIGS. 4A to 4C are explanatory drawings of examples of folding specifications in the apparatus shown in FIG. 3, wherein FIG. 4A shows a gate fold, 4B shows a Z fold, and 4C shows ¼ Z fold;

FIGS. 8A to 8D are explanatory drawings of the operation of the essential portion of the apparatus shown in FIG. 3, wherein FIG. 8A shows a finger member in an upright state, 8B shows the finger member in an inclined state, 8C and 8D show the operating states of the path switching member;

DETAILED DESCRIPTION OF THE INVENTION

Figure 1:
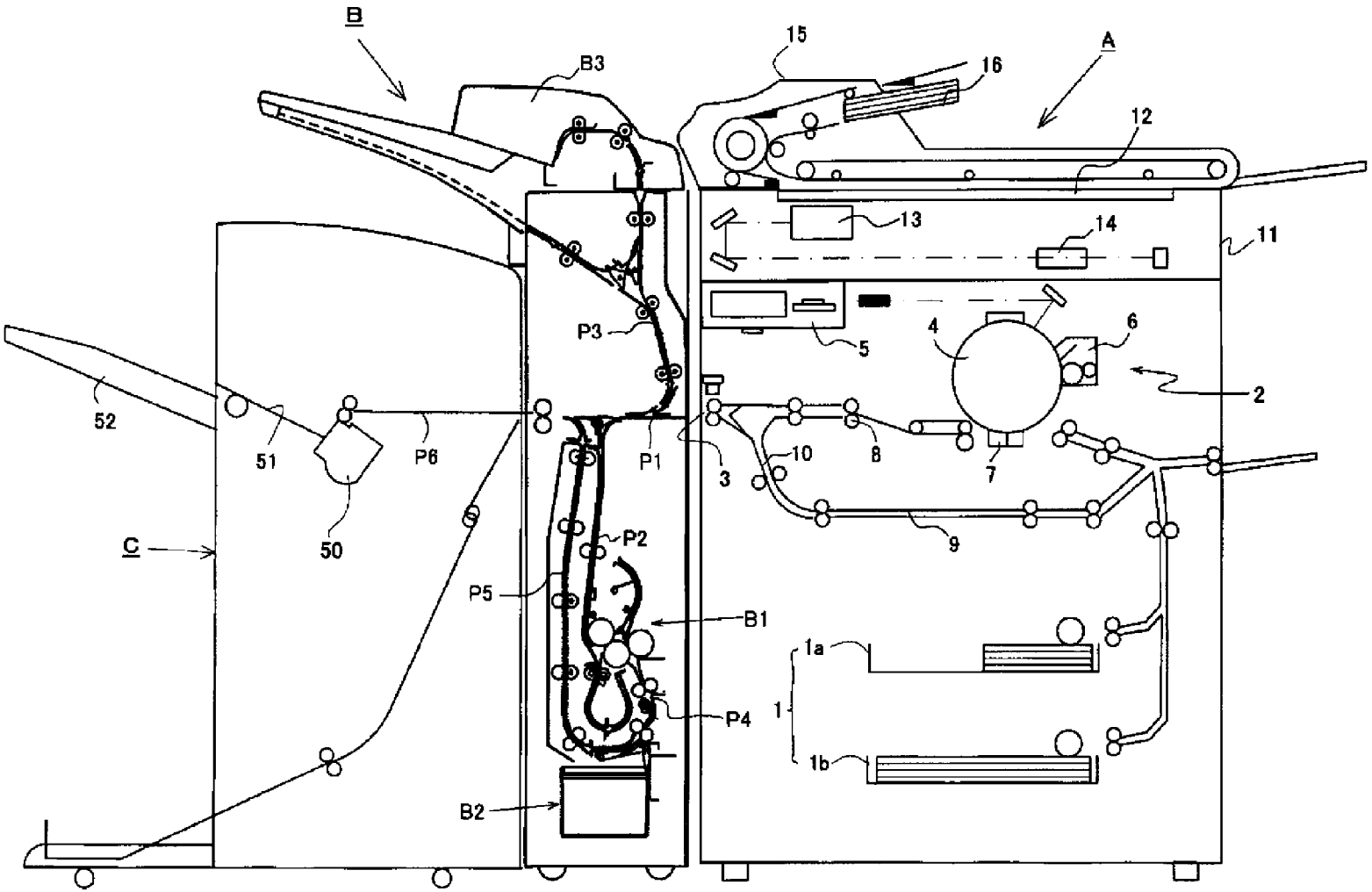
FIG. 1 shows the overall configuration of an image-forming system that incorporates a sheet-folding apparatus B of the present invention.
Figure 2:
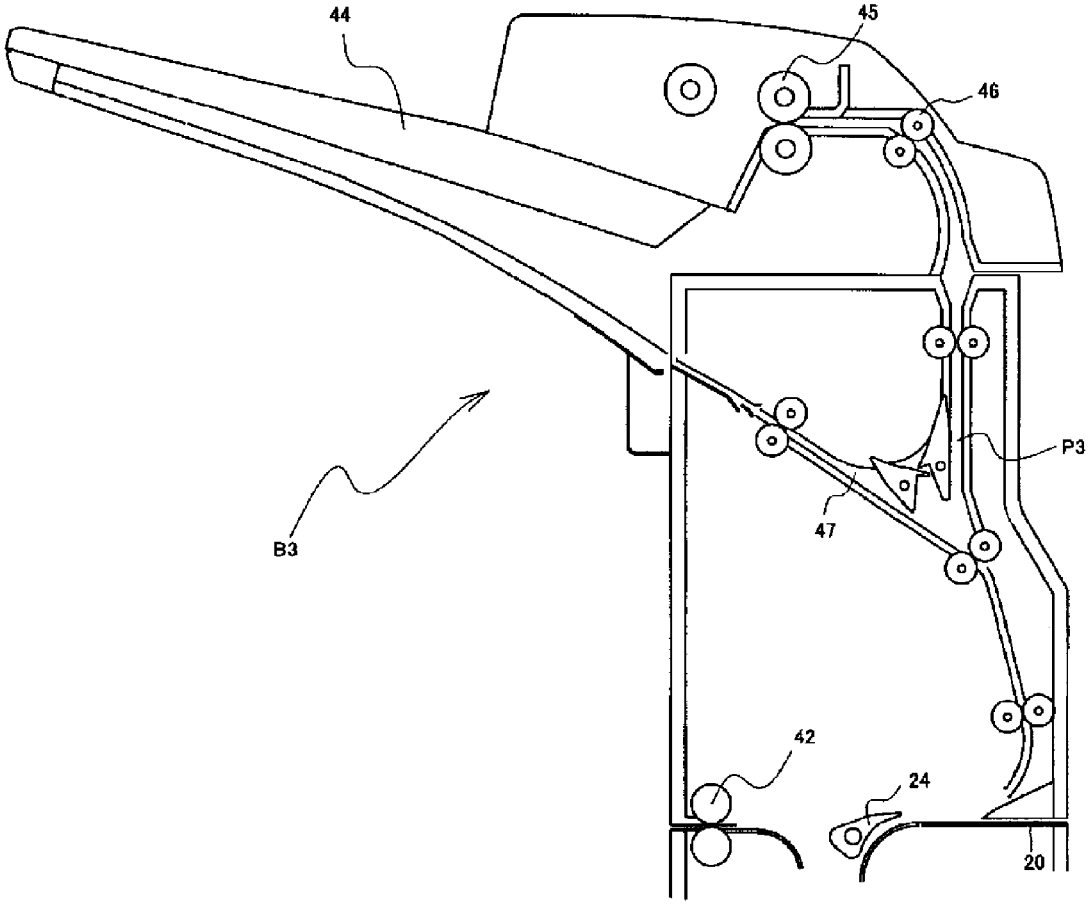
FIG. 2 is an explanatory drawing of an upper unit (inserter) of the sheet-folding apparatus B that configures a portion of the system shown in FIG. 1.
Figure 3:
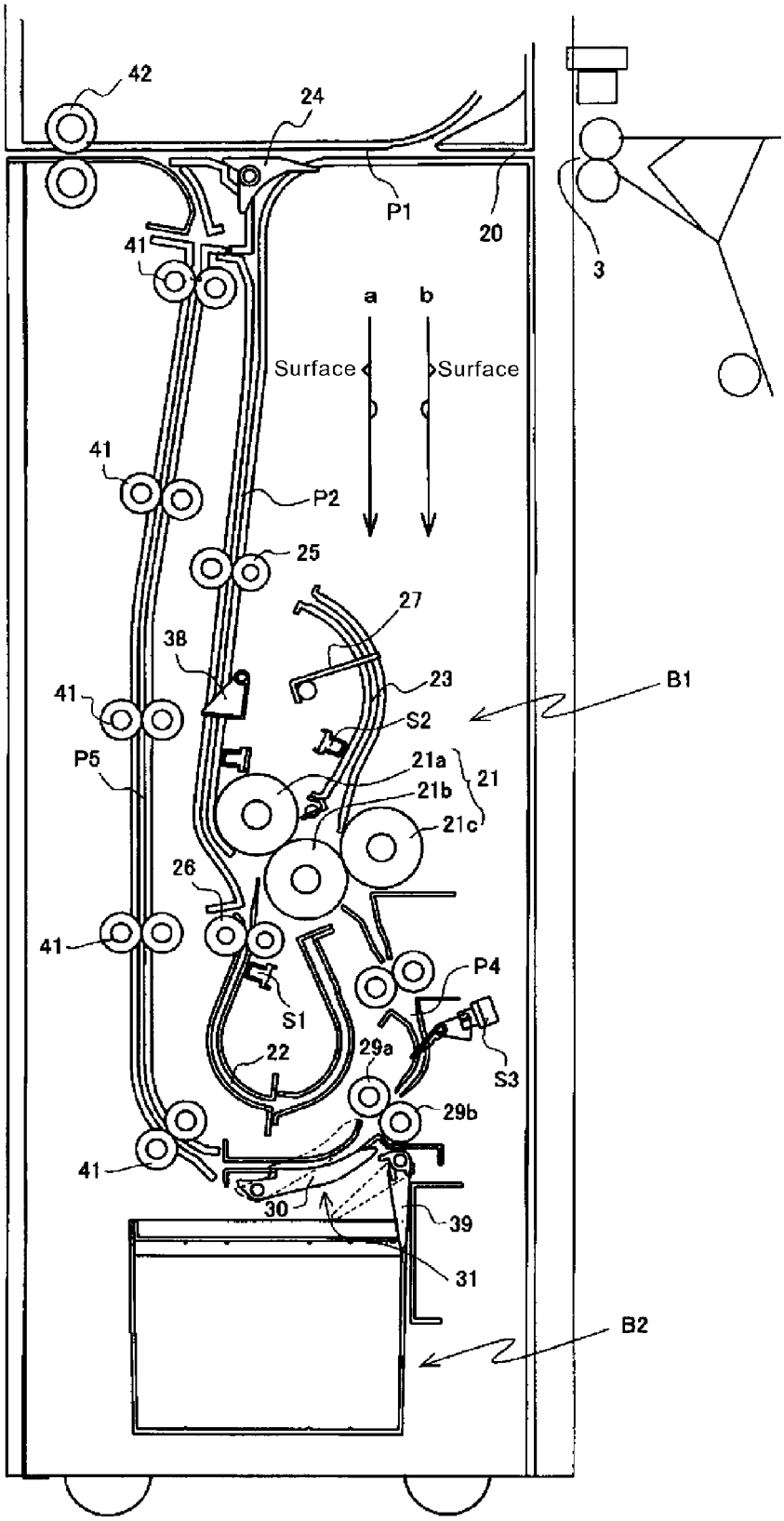
FIG. 3 is an explanatory drawing of a lower unit of the sheet-folding apparatus B shown in FIG. 1.
Figure 4A:
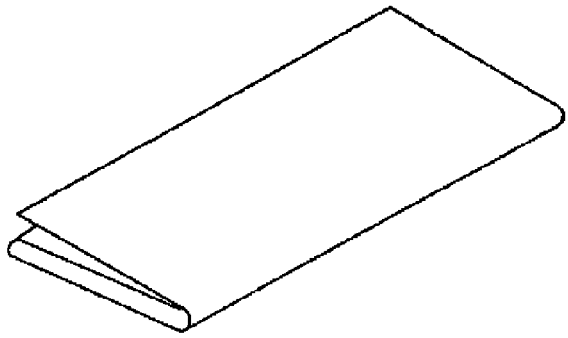
Figure 4B:
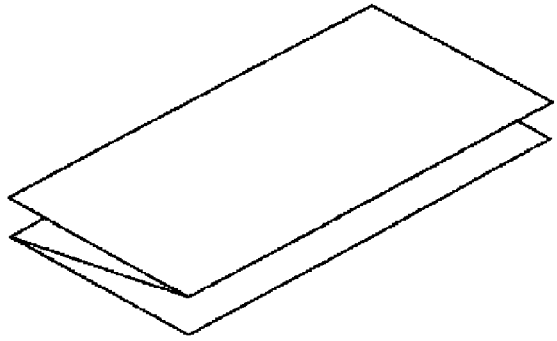
Figure 5:
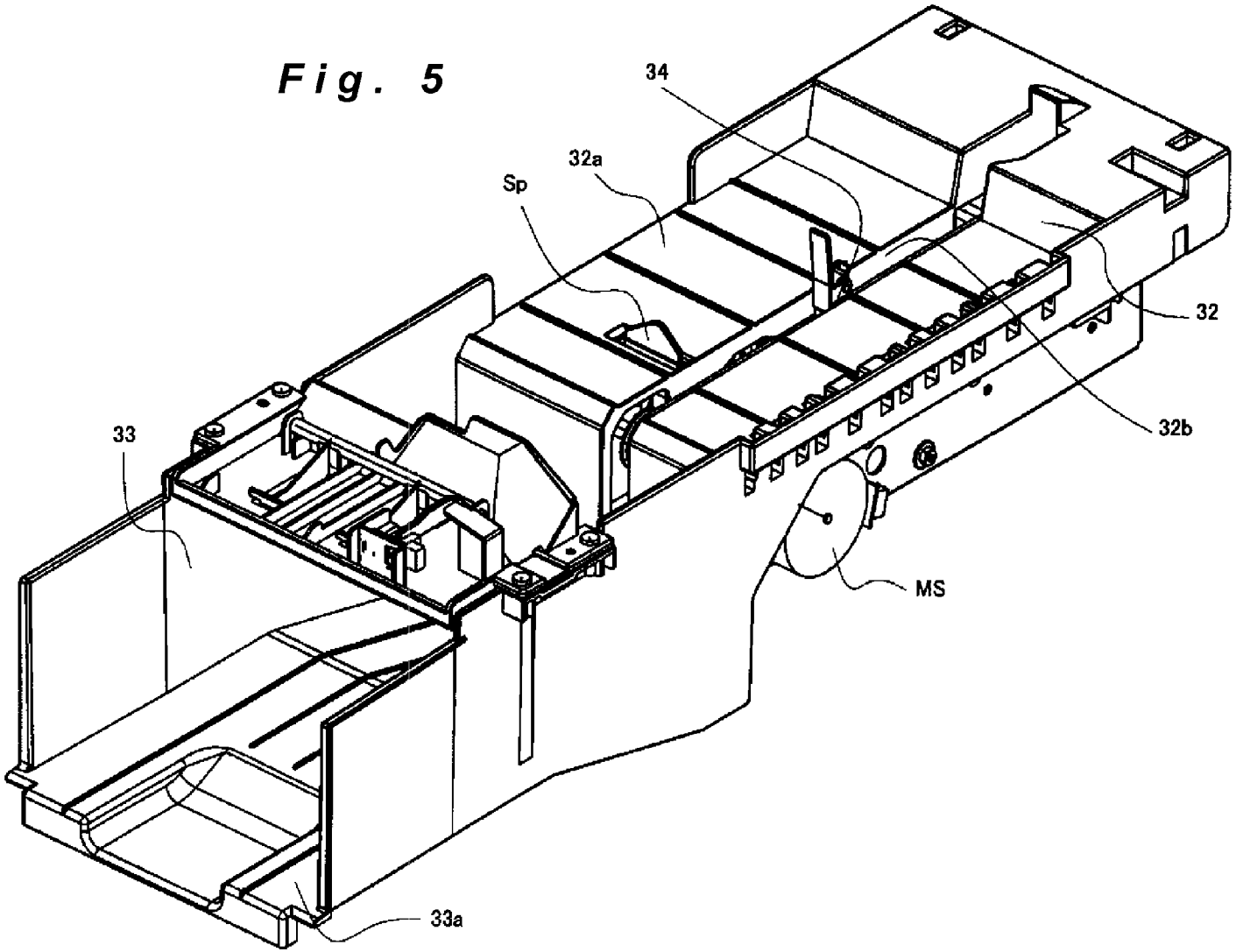
FIG. 5 is a perspective view of the overall configuration of the folded sheet stacking unit of the apparatus of FIG. 3.
Figure 6:
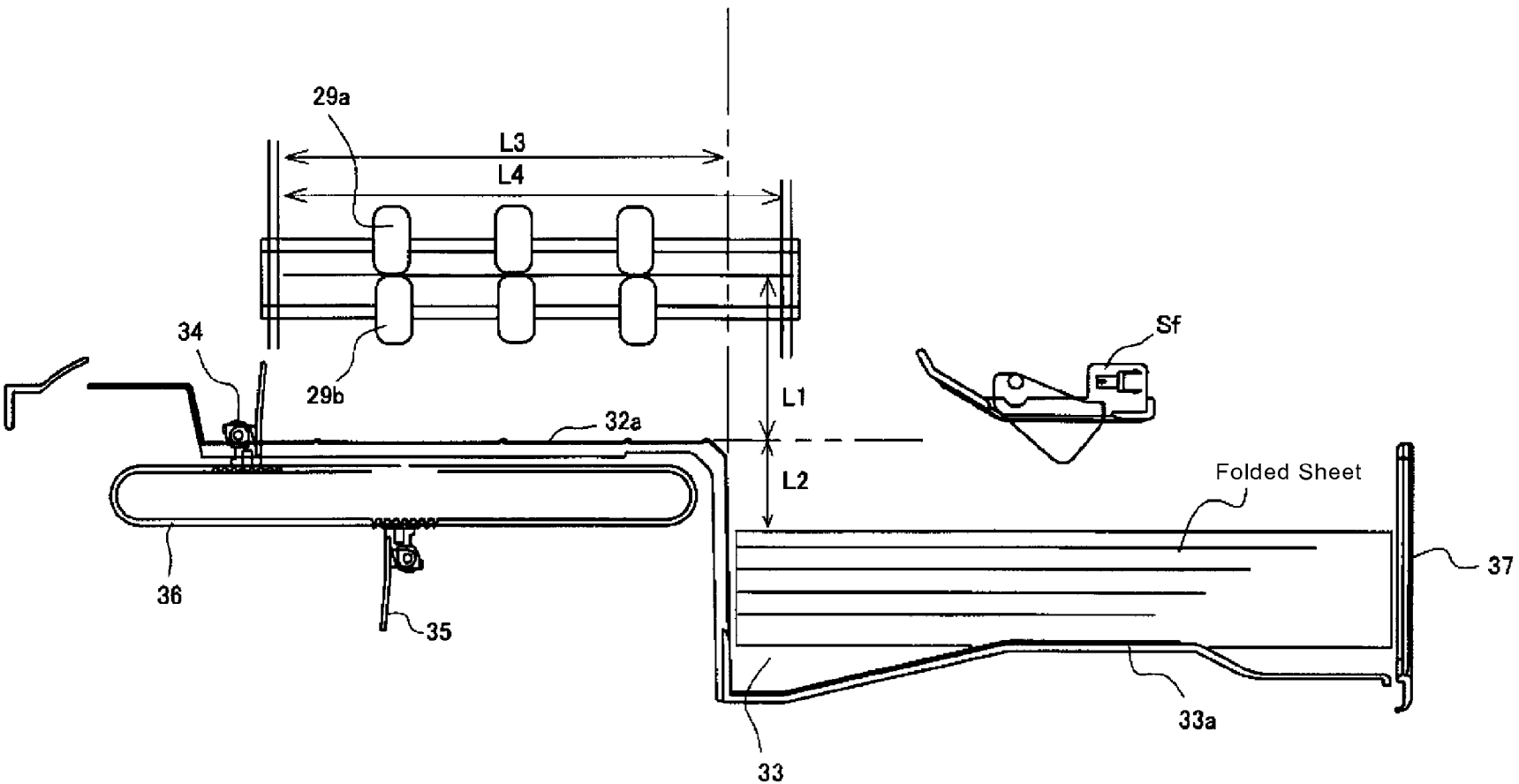
FIG. 6 is an explanatory drawing showing a sectional configuration of the stacking unit of FIG. 5.

Preferred embodiments of the present invention will now be explained with reference to the drawings provided. FIG. 1 shows the overall configuration of an image-forming system that incorporates a sheet-folding apparatus B of the present invention; FIGS. 2 and 3 are explanatory drawings of the overall folding apparatus that composes a portion of the image-forming system; FIG. 2 shows the upper unit; and FIG. 3 shows the lower unit. FIG. 4 is an explanatory view showing examples of the folding specifications; FIG. 5 is a perspective view of the structure of the sheet stacking unit; and FIG. 6 is a sectional, explanatory view of the sheet stacking unit.

The following will explain the image-forming system with reference to FIG. 1. The system shown in FIG. 1 is furnished with an image-forming apparatus A that forms images on sheets; a sheet-folding apparatus B that folds printed sheets into a predetermined shape; and a finisher C that applies a finishing process to sheets fed from that apparatus. Sheets can be conveyed sequentially downstream from the image-forming apparatus A, to the sheet-folding apparatus B and next to the finisher C.

Image-forming apparatus A conveys the sheet from a feeder unit 1 to a printing unit 2. After images are printed on the sheet at the printing unit 2, the sheet is conveyed out from a discharge outlet 3. The feeder unit 1 stores a plurality sheet sizes in feeder cassettes 1*a* and 1*b*, separates into a single sheet the specified sheet size and conveys that to the printing unit 2. The printing unit 2 is equipped with an electrostatic drum 4; a print head (such as a laser) 5 disposed in the vicinity thereof; a developer 6; a transfer charger 7; and a fixer 8. An electrostatic latent image is formed on the electrostatic drum by the laser 5, and the developer causes toner ink to adhere to that latent image. After the toner image is transferred to the sheet by the transfer charger 7, it is heat-fused to the sheet at the fixer. Sheets thus printed with images are sequentially conveyed out from the discharge outlet 3. The cycling path 9 is a duplex printing path for turning over (from front to back) a sheet printed on one side, received from the fixer, and re-feeding that sheet to the printing unit 2 so that the other side of the sheet can be printed. Duplex-printed sheets are then conveyed to the discharge outlet 3 after being turned over from back to front again at a switchback path 10.

An image-reading apparatus 11 uses photoelectric conversion elements to electrically read an original sheet set on a platen 12 by scanning with a scanning unit 13. The read image data is digitally processed, for example, at an image-processing unit, then transferred to a data-storage unit 14, and sent to the laser 5 as image signals. Also, a document feeder 15 feeds original sheets stored in a stacker 16 to the platen 12. An electrostatic printing mechanism is shown as an example of the image-forming apparatus A described above. However, other methods such as an ink jet mechanism and a screen printing mechanism and the like are known. Any of these can be adopted for use with the present invention.

The sheet-folding apparatus B is composed of a folding unit B1, a folded sheet stacker B2, and an inserter B3. A conveyance-in inlet 20 connected to the discharge outlet 3 of the image-forming apparatus A is furnished in the sheet-folding apparatus B; a sheet conveyance path P1 that conveys the sheet from the conveyance in inlet 20 to the finisher C, described below, intersects the sheet-folding apparatus B. A folding process path P2, and a paper feed path P3 that branches from the inserter B3 are linked to the sheet conveyance path P1.

The folding specifications executed by the folding unit B1 will now be explained with reference to FIG. 4. A single-fold, a Z fold or gate fold, and a ¼Z fold are often-used paper folding formats (folding styles) in image-forming systems. The following will now explain each type of fold.

Single Fold

A sheet conveyed from the image-forming apparatus A is folded at a ½ way position in the length of the sheet in the conveyance direction. Although not shown, the sheet is folded in half, at a central position. The folded ends of sheets can then be bound by stapling or gluing and the like to form a closed-end document. Furthermore, if holes are punched into the folded sheets, they can be used in a variety of document organizing methods, such as filing. In such cases, the sheet must be folded by folding rollers so that the printed surface (possible only for simplex printing) faces outward. Therefore, at least a pair of folding rollers, and registration means that calculates the folding position based on the leading edge or the trailing edge of the sheet are necessary in the folding process path P2.

Gate Fold

In this folding method, the sheet is folded at ⅓ positions of the leading edge and the trailing edge of the sheet in the length direction. The two end panels, specifically, the leading and trailing ends of the sheet, are mutually folded inward over a middle third panel. As shown in FIG. 4A, the leading end side of the sheet (in direction of sheet conveyance) is folded at a ⅓ position of the sheet, then the trailing end is folded over that panel at a ⅓ position of the sheet. A gate-folded sheet can be inserted into an envelope as a letter. In such cases, it is necessary for the printed side of the sheet (the front side when duplex printing has been applied) to be folded inward by the folding rollers. It is necessary to dispose a first pair of folding rollers that execute a first folding process, and a second pair of folding rollers positioned downstream of the first roller pair, in the folding process path P2. At the folding roller mechanism 21, described below, a sheet fed in the folding process path P2 in the manner (specifically, the front side of the sheet facing the left side of the drawing) indicated by arrow a in FIG. 3 is folded at the ⅓ position of the trailing edge by the first and second rollers 21*a*, 21*b*. The sheet is then folded at the ⅓ position of the leading edge by the second and third rollers 21*b*, 21*c*.

Z Fold

In this folding method, the sheet is folded at the ⅓ positions of the leading and trailing edges in the length direction of sheet conveyance. Specifically, the leading and trailing ends of the sheet are folded in opposite directions. As shown in FIG. 4B, the leading and the trailing ends of the sheet are folded in opposite directions at the ⅓ positions in the direction of sheet conveyance. Sheets folded in the Z-fold style can be inserted into an envelope as a direct mail. In such case, it is necessary that the printed side of the sheet (the front surface when duplex printing has been applied to the sheet) is folded so that the letter head portion of the sheet is facing outward so as to be visible. Therefore, a first pair of folding rollers must be disposed upstream, and a second pair of folding rollers must be disposed downstream of the first roller pair in the folding process path P2. At the folding roller mechanism 21, described below, a sheet fed in the folding process path P2 in the manner (the front surface of the sheet facing the right side of the drawing) indicated by arrow b in FIG. 3, is folded at the ⅓ position of the leading edge by the first and second rollers 21*a*, 21*b*; and the trailing edge of the sheet is folded at the ⅓ position by the second and third rollers 21*b*, 21*c*.

¼-Z Fold

Figure 4C:
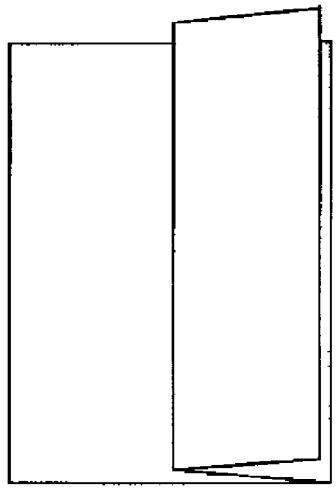

As shown in FIG. 4C, the sheet is folded at a one-quarter position of the sheet in the conveyance direction, then the sheet is folded at the ½ position of the original length of the sheet. Sheets folded in this way are then stacked as a series of documents. They can also be stapled, or holes can be punched therein for their filing. This makes it possible to bind large-sized documents, such as A3-size documents together with A4-sized documents. In such cases, the printed side of the sheet (the front surface when duplex printing has been applied to the sheet) must be at a ¼ position from the leading edge of the sheet, then the sheet is folded again at the ½ position of the original length of the sheet. Therefore, a first pair of folding rollers must be furnished at an upstream side and a second pair of folding rollers must be disposed downstream of the first roller pair in the folding process path P2. At the folding roller mechanism 21, described below, a sheet fed in the folding process path P2 in the manner (the front surface of the sheet facing the right side of the drawing) indicated by arrow b in FIG. 3, is folded at the ¼ position of the leading edge by the first and second rollers 21*a*, 21*b*; and then the sheet is folded at the ½ position by the second and third rollers 21*b*, 21*c*.

The structure of the folding unit B1 will now be explained with reference to FIG. 3. The folding process path P2 is linked to the sheet conveyance path P1 interposed by a path switching flapper 24; the folding roller mechanism 21 is disposed in the folding process path P2. A folded sheet path 23 branched in a T-shape is furnished adjacent to the folding process path P2, and a switchback path 22 is furnished downstream at a leading end of the folding process path P2. The folding roller mechanism 21 is furnished at the path branching point. The folding roller mechanism 21 shown in the drawing is composed of a first roller 21*a*, a second roller 21*b*, and a third roller 21*c*. The first and second rollers 21*a* and 21*b* are in mutual contact to nip the sheet; the second and third rollers 21*b*, and 21*c* are also in mutual contact to nip the sheet. Therefore, a first folding process is executed at the nipping point (the first folding unit) between the first and second rollers 21*a*, and 21*b*, and a second folding process is executed at the nipping point (the second folding unit) between the second and third rollers 21*b*, and 21*c*.

A conveyance roller 25 that conveys the sheet is disposed in the folding process path P2; the folding roller mechanism 21 is positioned downstream of the conveyance roller. A switchback roller 26 that is capable of both forward and reverse rotations and a sheet sensor S1 are disposed in the switchback path 22 downstream of the folding process path P2. The sensor S1 detects the leading edge of the sheet fed downstream (FIG. 3) by the switchback roller 26. After detecting the leading edge of the sheet, the switchback roller 26 further conveys the sheet a predetermined amount and then stops. Then, the ¼ position of the sheet is bowed by the conveyance roller 25 continuing to rotate, thereby causing the bowed ¼ position of the sheet to enter the nipping point of the first folding unit. Next, the switchback roller 26 is driven in reverse thereby backing up the leading edge of the sheet. At the same time as that reverse drive, the conveyance roller 25 continues to feed the trailing edge of the sheet. These two actions cause the sheet to enter nipping point between the first and the second rollers 21*a* and 21*b*. These rollers pull the sheet downstream into the folded sheet path 23. This is the mechanism used to calculate the sheet folding position based on the leading edge of the sheet to apply a folding process.

On the other hand, a trailing edge registration stopper 38 is provided downstream of the conveyance roller 25 to calculate the folding position based on the trailing edge of the sheet. After the trailing edge of the sheet is fed past the registration stopper 38 by the switchback roller 26, the switchback roller 26 rotates in reverse thereby abutting the trailing edge of the sheet against the registration stopper 38. This causes the sheet to form a bow based on the sheet's trailing edge position. The bowed portion advances into the nipping point of the first and second rollers 21*a*, and 21*b* (the first folding unit). Thus, the first folding process is executed based on the trailing edge of the sheet. Note that the sheet stopper mechanism is composed of a flapper-shaped stopper 38. This stopper 38 is configured to retract from the path when the sheet advances downstream in the folding process path P2, and to advance back into the path when the sheet is being conveyed upstream to stop the trailing edge of the sheet. This stopper 38 that registers the trailing edge of the sheet can also be composed of the conveyance roller 25 as a switchback roller capable of forward and reverse rotations. Switchback rollers at the leading end of the path can also be configured for position registration.

Sheets whose folding positions are calculated by either their leading edge or their trailing edge when supplied to the first folding unit are folded by the first and second folding rollers 21*a*, and 21*b*, and then conveyed into the folded sheet path 23. A sheet detection sensor S2 and movable stopper 27 are disposed in the folded sheet path 23. The movable stopper 27 is configured to move into the folded sheet path 23 to register the leading edge position of the sheet according to the sheet size and folding specifications. The leading edge of the folded sheet fed by the first and second rollers 21*a*, and 21*b* abuts the movable stopper 27 and is registered. This also forms a bow in the trailing edge side. This bow causes the sheet to advance into the nipping point between the second 21*b* and third roller 21*c* so the trailing edge side of the sheet is folded. A first discharge path P4 is disposed downstream of the nipping point (the second folding unit) of the second and third rollers 21*b* and 21*c*. Sheets folded at the first and second folding units are conveyed out to the first discharge path P4. Note that in the event that the sheet does not require a second folding, for example if only a single fold is applied to the sheet, the movable stopper 27 retracts to a non-operational, standby position so that the sheet can be conveyed out to the first discharge path P4 without being folded at the nipping position of the second and third rollers 21*b* and 21*c*.

Figure 8A:
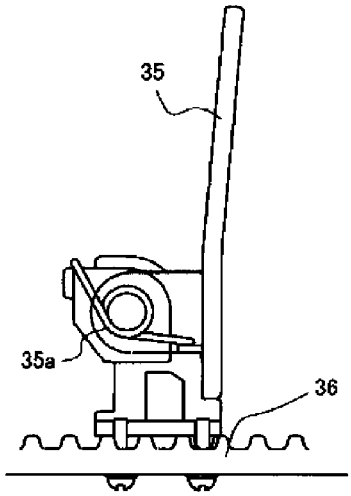

The first discharge path P4 is composed of path guides 28*a* and 28*b* (see FIG. 8C) that guide folded sheets, and conveyance out rollers 29*a* and 29*b*. Each of the pair of rollers is configured to nip the folded sheet and convey it downstream at the same time as securely folding it. A path switching member 30 and first discharge outlet 31 are furnished at the outlet end of the first discharge path P4. A second discharge path P5 is linked downstream to the first discharge path P4 interposed by the path switching member 30; the second discharge path P5 conveys folded sheets to a finisher C described below. Conveyance means (the first conveyance means) that conveys one sheet at a time downstream of the folding roller mechanism 21 is composed of discharge rollers 29*a*, and 29*b*. This pair of rollers conveys the folded sheet in a direction perpendicular to the direction of the paper fold. Conveying the folded sheet with the discharge rollers 29*a* and 29*b* securely creases the fold in the sheet. A folded sheet stacker B2 that stores sheets is provided below the first discharge outlet 31.

As shown in FIG. 5, the folded sheet stacker B2 is composed of a tray member 32 that temporarily stacks folded sheets conveyed from the first discharge outlet 31, and a stacker 33 linked to the tray member 32, that stores the folded sheets. Of particular note, the folded sheet is conveyed from the tray member 32 into the stacker 33 in the direction of the folded seam. The stacker 33 is disposed so that an access port is positioned at the front side of the apparatus (the front side of FIG. 1). The tray member 32 is composed of a tray member that has a support surface 32*a* formed at a level-split L1 (see FIG. 6) below the first discharge outlet 31. The sheet conveyance direction length L3 (see FIG. 6) of the support surface 32*a* is formed to be shorter than length of the folding direction of at least the maximum size of sheet L4. These lengths have a relationship of L3<L4. The length L3 of the support surface 32*a* is set to correspond to the apparatus specifications with the relationship of the maximum size length and the minimum size width.

Figure 8B:
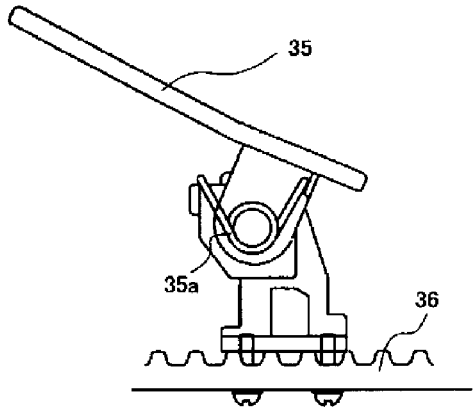
Figure 8C:
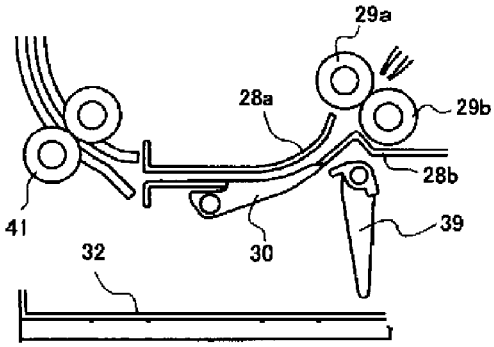

A paper sensor Sp that detects a sheet that has fallen from the first discharge outlet 31, and a shift means 34 that moves the sheet on the support surface 32*a* to the stacker 33 are disposed in the tray member 32. This shift means 34 is composed of a finger member 35 that projects through the top of the support surface 32*a*, a belt member 36, and a shift motor MS that drives the belt member 36 to move the finger member 35 from one end (the left side of FIG. 6) of the support surface 32*a* to another end (the right side of that drawing). Therefore, the finger member 35 mounted to the belt member 36 circulates around the back and front sides of the tray member 32, as shown in FIG. 6. Also, the finger member 35 is supported by a spring 35*a* to pivot on the belt member 36. As shown in FIG. 8B, the spring 35*a* urges the finger member 35 to lay over when it comes into contact with sheets on the stacker 33. The tray member 32 is formed with a slot 32*b* for being fit out with the finger member 35.

Figure 7:
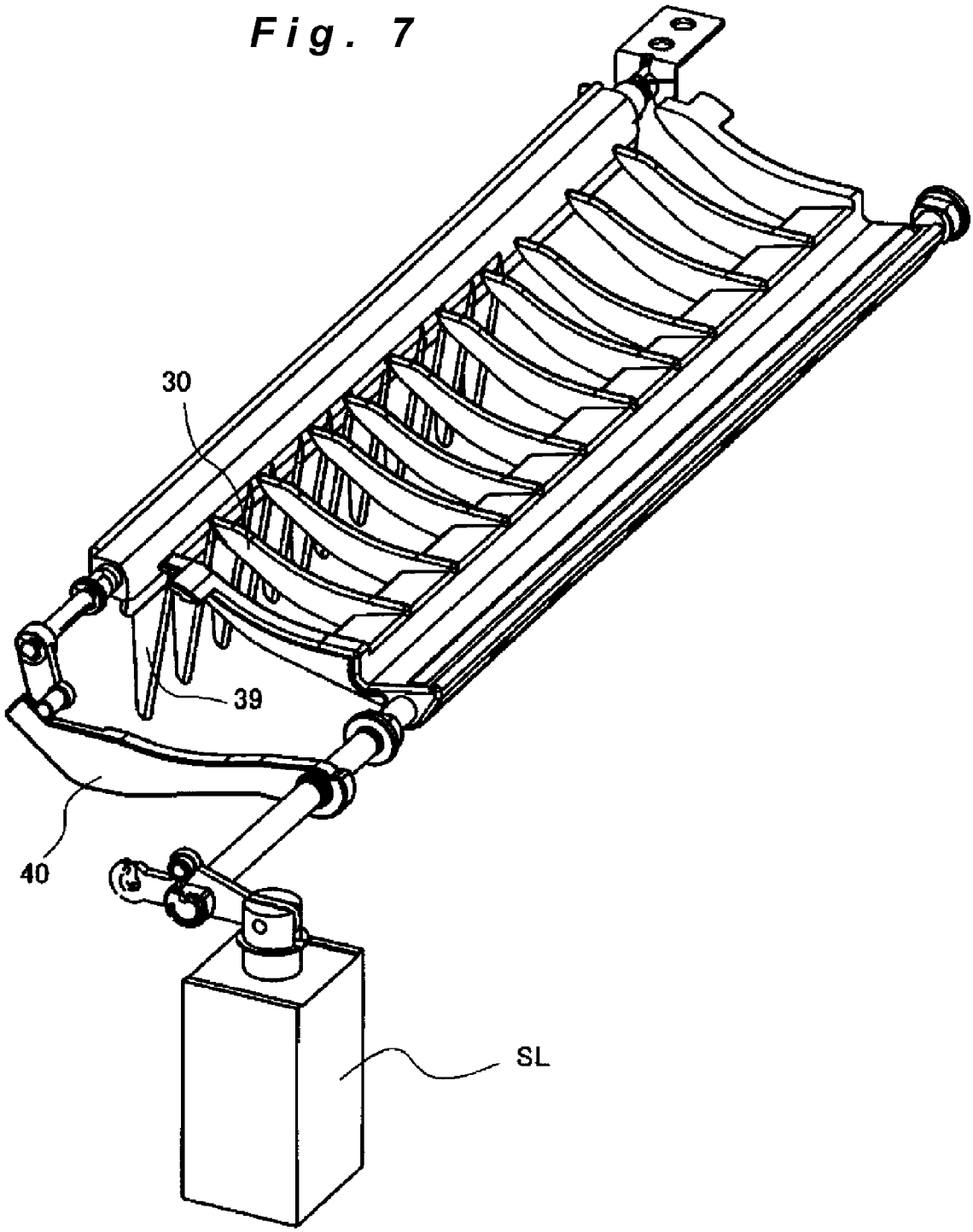
FIG. 7 is a perspective view of the configuration of a path switching member in the apparatus of FIG. 3.

The stacker 33 is disposed downstream of the tray member 32 configured as described above. As shown in the drawing, the stacker 33 is composed of a box shape to store folded sheets on the bottom wall 33*a*. The number 37 (see FIG. 7) in the drawing represents an opening door on the front side of the apparatus shown in FIG. 1. The bottom wall 33*a* is set to a depth forming a level-split (second level-split) L2 between the maximum number of storable sheets (the tolerable maximum number of sheets) and the support surface 32*a* of the tray member 32. FIG. 6 shows a full detection sensor Sf.

Figure 8D:
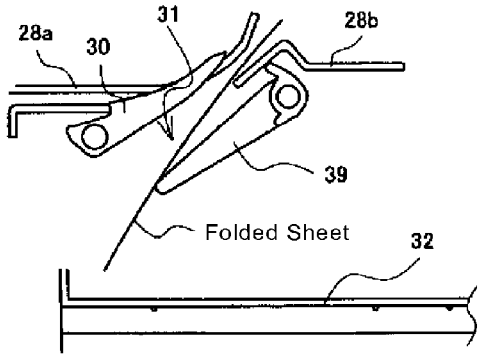
Figure 9:
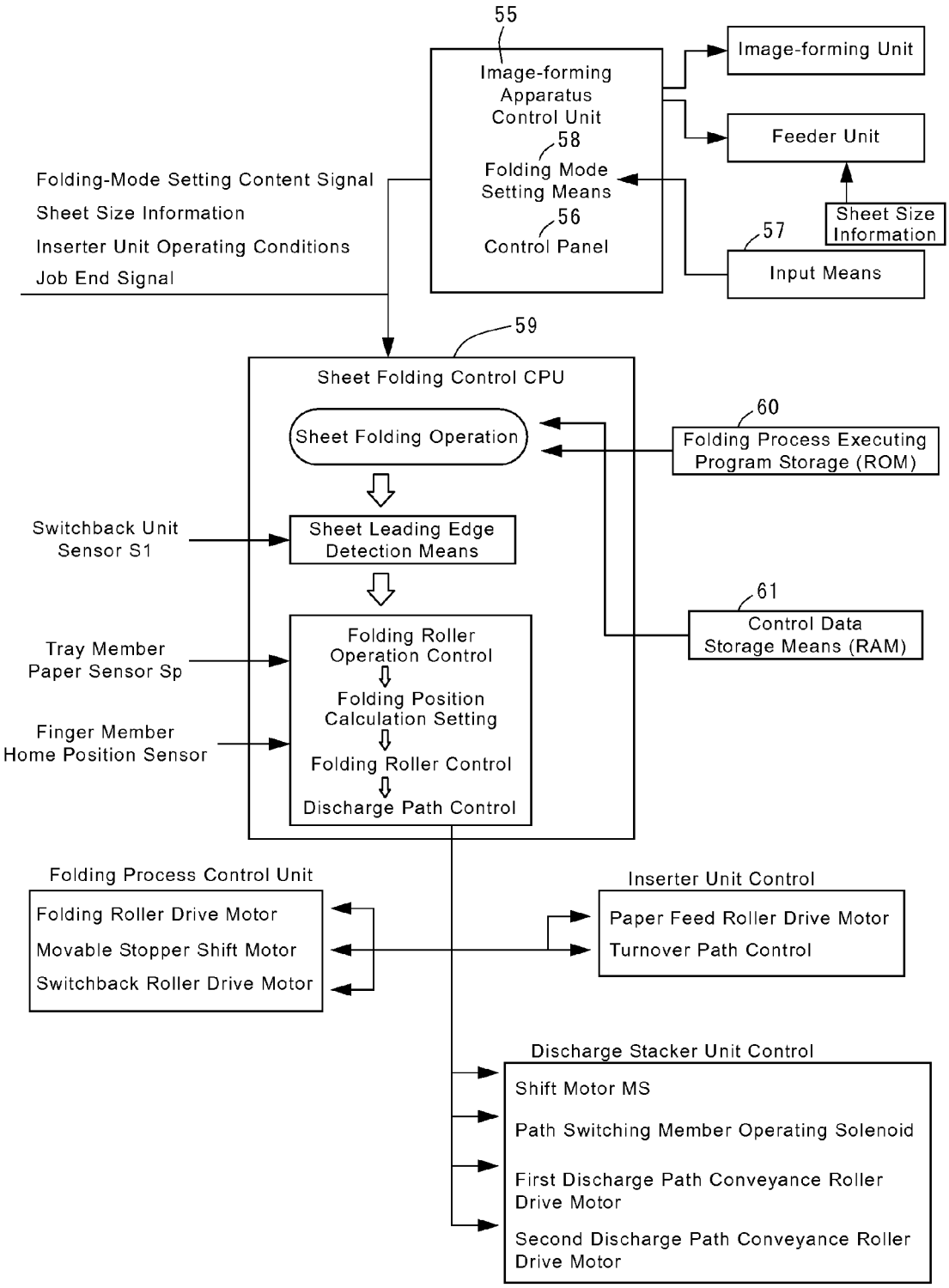
FIG. 9 is an explanatory diagram of the configuration of a control unit in the apparatus of FIG. 3.
Figure 10:
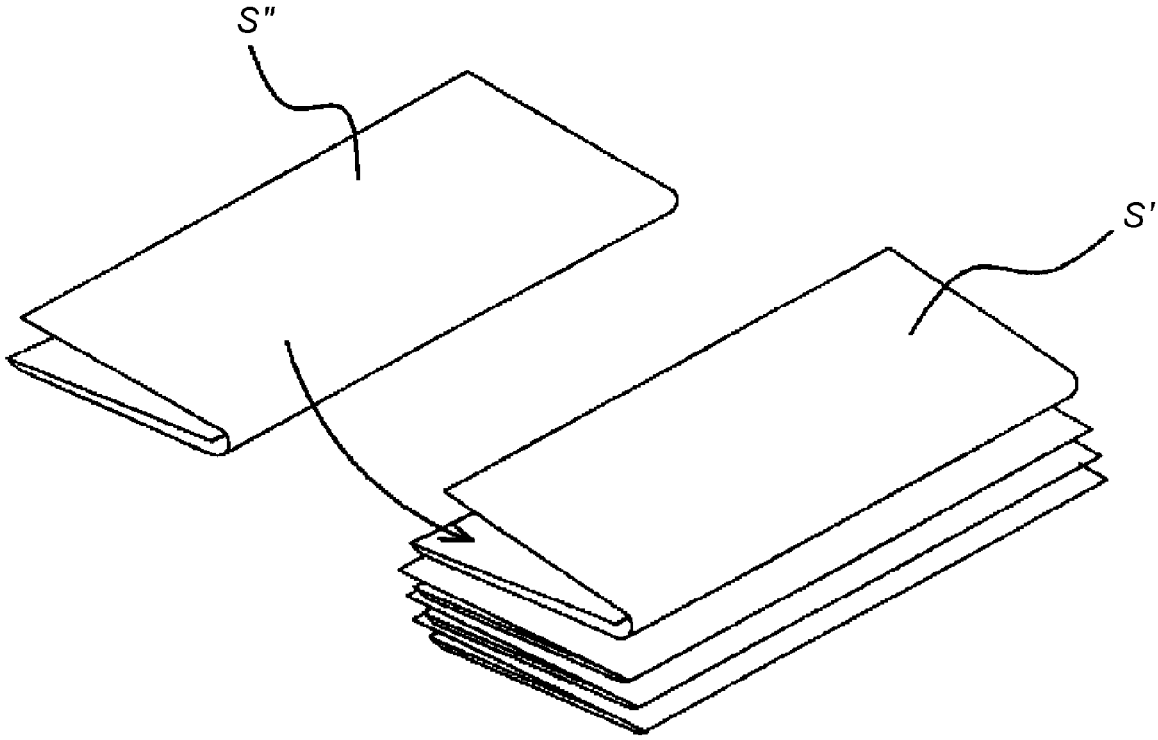
FIG. 10 is an explanatory drawing of a problem to be solved by the present invention, showing a sheet S" discharged from folding rollers entering a fold of a sheet S' on the stacking tray.

Folded sheets from the first discharge outlet 31 are stored in the tray member 32, but the guide member 39 is interlocked with the path switching member 30 so that the leading edge of the folded sheet does not get caught in the slot 32*b* formed in the support surface 32*a*. The path switching member 30 of the first discharge outlet 31 is formed to open the first discharge path P4. A lever 40 interlocked to the path switching member 30 moves the guide member 39 from a standby position shown in FIG. 8C to a guiding position shown in FIG. 8D. At the guiding position, the guide member 39 guides the folded sheet to fall from the first discharge outlet 31 into the tray member 32. This prevents the leading edge of the sheet from getting caught in the slot 32*b*. A solenoid SL opens and closes the path switching member 30 and the guide member 39; S3 is a sheet sensor.

One end of the second discharge path P5 is linked to the first discharge path P4 and the other downstream end is linked to the sheet conveyance path P1 to guide the sheet to the finisher C disposed downstream. Conveyance rollers 41 are provided at appropriate intervals in the second discharge path P5. The folded sheet guided to the sheet conveyance path P1 is conveyed out of the sheet-folding apparatus B by the discharge roller 42 provided in the sheet conveyance path P1.

As described above, a printed sheet is conveyed in from the image-forming apparatus A to the folding unit B1 but in addition to this, a sheet can be selectively conveyed from the inserter B3 for the folding process. As shown in FIG. 1, the folding unit B1 is disposed in the bottom portion of the apparatus and the inserter is disposed in the top portion of the apparatus. These units sandwich the sheet conveyance path P1. The inserter B3 is composed of a feeder tray 44 where sheets such as cover sheets or a divider sheet can be set; a separating means 45 that separates and feeds one sheet on the tray at a time; and the paper feed path P3 that guides the separated sheet to the sheet conveyance path P1. The separating means 45 is ordinarily composed of a friction roller (paper feed roller) and separating roller; a registration roller 46 is disposed downstream thereof. Of particular note, the drawing shows a turn-over path 47 provided in the paper feed path P3 that turns a sheet from the registration roller 46 over from front to back. Therefore, it is possible to guide a sheet from a different printing process, not supplied from the image forming apparatus A, or to set a cover sheet in the feeder tray 44 to insert in front and behind sheets. It is also possible to set divider sheets in feeder tray 44 to insert the dividers into the sheet conveyance path P1 for insertion between the pages at appropriate times.

The following will now explain the finisher C. A sheet from the discharge roller 42 of the sheet conveyance path P1 is conveyed into the finishing process path P6 shown in FIG. 1. A stapler 50 that staples sheets is disposed in the finishing process path P6. The system aligns sheets from the image-forming apparatus A or the inserter B3, or folded sheets fed directly from the sheet conveyance path P1 or from the second discharge path P5 via the folding unit B1 in a processing tray 51. Then, aligned sheets are stapled together by the stapler 50. Sheets bound at the processing tray 51 are then stored in the storage tray 52. Of course, sheets or folded sheets that do not require finishing at the processing tray 51 pass through the processing tray 51 to be stacked in the storage tray 52.

A gluing apparatus can also be furnished in the finisher instead of the stapler 50. In that case a back edge of a sheet bundle aligned in the processing tray is applied with glue, then a cover sheet is creased over that glued edge. A configuration that applies adhesive tape is also possible. It is also possible to adopt systems for hole-punching or applying marks, such as a seal and the like, by incorporating a hole-punching unit or stamping unit in the finishing process path P6 along with the stapler 50.

The following will now explain the actions of the sheet-folding apparatus B configured as describe above. When a sheet does not require finishing, such as when the sheet is folded in a gate fold (letter specification), the sheet is conveyed from the first discharge outlet 31 of the first discharge path P4 and stored in the stacker 33. When using other folding specifications, the system conveys the sheet via the second discharge path P5 and stores it in the storage tray 52 of the finisher C. A control panel 56 is provided on the control unit 55 of the image-forming apparatus A; the control unit 55 sets the sheet folding mode. An operator uses an input means 57 connected to the control panel 56 to set a folding process mode that executes a folding process on the sheet, a finishing process mode that executes a finishing process such as stapling, hole-punching and marking sheets without applying the folding process, or a discharge mode that stacks sheets in the storage tray 52 without the folding or finishing processes being executed on the sheets according to the mode setting means 58.

The folding process mode setting sets the type of folding process (the folding specification mentioned above) and the folded sheet finishing process, such as whether to finish the folded sheet at the finisher, or discharge the sheet unfinished. This also sets whether to supply a cover sheet or divider sheet from the inserter B3 along with these processes. At the same time as setting the mode as describe above, the control unit 55 transmits the sheets size information and job end signal to the downstream sheet-folding apparatus.

The control unit 59 of the sheet-folding apparatus B is composed of a control CPU. The control unit 59 can be integrated to the control unit 55 of the image-forming apparatus A or the control unit of the finisher C, or it can be furnished separately to the sheet-folding apparatus. A ROM 60 that stores folding execution programs and a RAM 61 that stores control data are provided in the control unit (control CPU) 59. The folding execution program executes folding processes with the folding specifications described above by controlling the conveyance roller 25 of the folding process path P2, the conveyance out rollers 29*a*, and 29*b*, the folding roller mechanism 21 and the movable stopper 27. This program selects whether to move the folded sheet fed into the first discharge path P4 from the first discharge outlet 31 to the stacker 33 or to move the folded sheet from the second discharge path P5 to the finisher C according to the folding specifications, at the same time as executing a folding process described above. The drawings show sheet sizes of A4 or letter size. The sheet is conveyed from the first discharge path P4 and is stored in the stacker 33 for gate fold folding specifications. For other folding specifications, the sheet is conveyed out from the second discharge path P5 to the finisher C.

When the sheet size is A4 or letter size and a gate fold is applied thereto, the control unit 59 discharges the sheet from the discharge outlet 3 of the image-forming apparatus A facing upward. The sheet is handed over and conveyed into the folding process path P2 in the manner indicated by arrow a in FIG. 3. Next, the sheet passes through the folding roller mechanism 21 and advances into the switchback path 22 downstream. At the point where the trailing edge of the sheet passes the stopper member 38 of the folding process path P2, the control CPU 59 rotates the switchback roller 26 in reverse. At that point, the trailing edge of the sheet is registered at the stopper member 38, and the center of the sheet is bowed in the direction of the nipping point between the first and second rollers 21*a* and 21*b*. The sheet is nipped between the two rollers, and the first folding process is executed therebetween. The length of the distance between the stopper member 38 and the nipping point is set to ⅓ the length of the sheet. Therefore, the printed surface of the sheet is folded inward at the ⅓ position from the trailing edge of the sheet, and the leading edge of the fold advances into the folded sheet path 23.

The control CPU 59 moves the movable stopper 27 to a position in the path 23 that corresponds to the length of the sheet after the folding process. This movement is achieved by the use of a motor (not shown) connected to the movable stopper 27. The crease of the sheet folded at the ⅓ position from the trailing edge touches the movable stopper 27 and is registered. Then, the leading edge (at the trailing end of the folded sheet path 23) of the sheet fed by the first and second rollers 21*a* and 21*b* is bowed and nipped by the second and third rollers 21*b* and 21*c*. The printed surface of the sheet is folded inward between the second and third rollers 21*b* and 21*c*. The distance between this nipping point and the movable stopper 27 is set to a ⅓ length of the sheet. Therefore, the sheet is folded at the ⅓ position from the leading edge by the second and third rollers 21*b* and 21*c* after the ⅓ position from the trailing edge of the sheet is folded by the first and the second rollers 21*a* and 21*b* to fold the sheet into a gate fold.

The folded sheet is fed from the second and third rollers 21*b* and 21*c* to the first discharge path P4. The control CPU 59 rotatingly drives the conveyance rollers 29*a*, and 29*b* disposed in the first discharge path P4 to convey the sheet from the folding rollers further downstream. The sheet fed in a direction perpendicular to the fold by the rollers 29*a*, and 29*b* is securely folded at the fold by being pressed at the same time between the rollers. When the sheet is conveyed out, the solenoid SL activates to move the path switching member 30 from the state shown in FIG. 8C and open the first discharge outlet 31. When the sheet reaches the first discharge outlet 31 from the first discharge path P4, the sheet falls from the opened first discharge outlet 31. The guide member 39 connected to the path switching member 30 by the lever 40 is moved from the standby position shown in FIG. 8C to the actuating position of FIG. 8D.

In the actuating position, the guide member 39 guides the sheet from the first discharge path P4 to the support surface 32*a* of the tray member 32, having the level-split L1, disposed below. The guide member 39 at this time guides the sheet so that it does get caught in the slot 32*b* formed in the tray member 32. The standby position (the state shown in FIG. 8C) of the guide member 39 is set to a position (inclination) where the sheet conveyed from the first discharge path P4 to the downstream second discharge path P5 does not enter that path.

At this time, the control CPU 59 controls the shift motor MS of the finger member 35 disposed in the support tray 32*a* to idle at a home position (left side of FIG. 6) so that it does not hinder the advancement of the sheet on the support tray 32*a* of the tray member 32. The sheet falls onto the support surface 32*a* and activates the paper sensor Sp. The control CPU 59 starts the shift motor MS at the signal from the paper sensor Sp to move the finger member 35 from the left side of FIG. 6, to the right side. When this occurs, the sheet on the support surface 32*a* is pressed on its trailing edge and moved along the surface by the finger member 35. The leading edge of the sheet at this time is gradually pushed to the right so that it is stacked upon the sheets stored in the downstream stacker 33 when the sheet falls and is stored on the support surface 32*a*. The sheet is conveyed in the direction of its fold and moved to the top surface of the stacker 33.

The finger member 35 is configured to pivot by the spring 35*a* as described above so after the sheet is shifted to the top of the stacker 33, it is pushes the sheet on the stacker 33 and lays down along with the movement of the belt member 36 and recovers to the backside of the tray member 32. The finger member 35 is configured to be at its home position so as not to interfere with the movement of the sheet.

Folding specifications such as a single fold, Z fold and ¼-Z fold that differ from the folding specifications described above will now be explained. When applying a Z fold to the sheet, the control unit 59 discharges the sheet from the discharge outlet 3 of the image-forming apparatus A facing downward and the sheet conveyed to the folding process path P2 in the manner indicated by arrow b in FIG. 3. Next, the sheet passes by the folding roller mechanism 21 and advances into the switchback path 22 downstream. At the point where the leading edge of the sheet is conveyed a predetermined amount downstream, the switchback roller 26 is driven in reverse while the conveyance roller 25 is stopped. At that point, the trailing edge of the sheet is restrained by the conveyance roller 25, and the center of the sheet is bowed in the direction of the nipping point between the first and second rollers 21*a* and 21*b*. The sheet is nipped between the both rollers, and the first folding process is executed therebetween. The length of the distance between amount of feeding of the switchback rollers 26 and the nipping point is set to ⅓ the length of the sheet. Therefore, the printed surface of the sheet is folded outward at the ⅓ position from the leading edge of the sheet, and the leading edge of the fold is advanced into the folded sheet path 23.

The control CPU 59 moves the movable stopper 27 to a position in the folded sheet path 23 that corresponds to the length of the sheet after the folding process. This movement is achieved by the use of a motor (not shown) connected to the movable stopper 27. The sheet folded at the ⅓ position from the leading edge abuts the movable stopper 27 with its folded edge and is registered. Then, the trailing edge of the sheet fed by the first and second rollers 21*a* and 21*b* is bowed. This bowed portion is nipped between the second and third rollers 21*b* and 21*c*. The printed surface of the sheet is folded inward between the second and third rollers 21*b* and 21*c*. The distance between this nipping point and the movable stopper 27 is set to a ⅓ length of the sheet. Therefore, the sheet is folded to the inside at the ⅓ position from the trailing edge by the second and third rollers 21*b* and 21*c* after the ⅓ position from the leading edge of the sheet is folded by the first and the second rollers 21*a* and 21*b* to fold the sheet into a Z fold.

Note that when applying a ¼-Z fold, the sheet is folded at the ¼ position of the sheet size for a first folding process, using the same procedures as the Z fold described above. Then, the sheet is folded at its ½ position. Also, for the ½ fold, it is acceptable to fold the sheet using the first and second rollers 21*a*, and 21*b* using the leading or the trailing edge of the sheet as a reference.

The sheet folded in a ¼-Z fold or a ½ fold is fed from the second and third rollers 21*b* and 21*c* to the first discharge path P4. The control CPU 59 rotatingly drives the conveyance rollers 29*a*, and 29*b* disposed in the first discharge path P4 to convey the sheet from the folding rollers further downstream. The crease in the sheet fed in a direction perpendicular to the fold by the rollers 29*a*, and 29*b* is further pressed between those rollers. When the sheet is conveyed out, the control CPU moves the path switching member 30 to the state shown in FIG. 8C to guide the sheet from the first discharge path P4 into the second discharge path P5. The sheet is conveyed to the finishing process path P6 of the finisher C via the sheet conveyance path P1; the sheet is finished at the finishing process path P6 and then stored in the storage tray 52 thereafter. Also, when an operating mode that does not apply a finishing process to sheets is used, the sheet is conveyed out to the storage tray via the finishing process path P6.

When applying the folding processes described above, and the sheet is being fed from the inserter B3, the sheet is fed from the feeder tray 44 to the sheet conveyance path P1 via the paper feed path P3. In such case, if it is necessary to turn the sheet over from top to bottom because of the printed surface, the sheet is conveyed from the paper feed path P3 and is turned over at the turn-over path 47, then fed to the folding process path P2.

This application claims priority rights from Japanese Pat. App. No. 2006-152680, which is herein incorporated by reference.

What is claimed is:

1. A sheet folding apparatus comprising:

a folding process unit for folding sequentially delivered sheets into a predetermined form defining a crease orientation;

a folded sheet stacking unit for stacking and stowing folding-processed sheets from said folding process unit; and conveyance means, provided between, for cooperative operation with, said folding process unit and said folded sheet stacking unit, for conveying one folding-processed sheet at a time from said folding process unit into said folded sheet stacking unit, said conveyance means comprising an upstream, first conveyance means constituted by a pair of rollers for nipping and thereby conveying sheets, said first conveyance means therein for conveying folding-processed sheets from said folding process unit in a direction approximately orthogonal to the crease orientation, and a downstream, second conveyance means including a tray member for bearing folding-processed sheets from said first conveyance means, and a shift member, provided so as to circulate around the front and back sides of the tray member along an engagement slot formed in said tray member, extending along the sheet-crease orientation, said shift member being configured to engage the trailing edges of folding-processed sheets on said tray member to convey the sheets along the tray member in the crease orientation into said folded sheet stacking unit, and being configured to be free to bob so that coming into contact with sheets on said sheet stacking unit in the course of the circulating of said shift member topples it.

2. The sheet folding apparatus according to claim 1, wherein:

said sheet stacking unit is constituted by a stacker for loading/stowing sheets from said conveyance means; and between said first conveyance means and said tray member a first level-split for drop-accommodating sheets, and between said tray member and said stacker a second level-split for drop-accommodating sheets are respectively formed.

3. The sheet folding apparatus according to claim 2, further comprising:

a sheet discharge path running from a downstream side of said first conveyance means, for conveying further downstream sheets from said folding process unit;

a path switching member provided in the sheet discharge path for selectively guiding to the sheet discharge path or to said tray member sheets from said first conveyance means; and a guide member provided above the tray member, for guiding sheets from said path switching member onto said tray member; wherein said guide member is configured to be free to shift between a retracted position where it does not hinder the conveying of sheets in the sheet discharge path, and a guiding position for guiding sheets to said tray member.

4. An image-forming system comprising:

an image forming apparatus for imaging onto sheets;

a sheet folding apparatus for folding sheets from said image-forming apparatus; and a finisher for stacking into a bundle and binding together sheets from said folding apparatus; wherein said sheet folding apparatus is provided with a sheet discharge path for conveying sheets from said image-forming apparatus to said finisher, and a folding process path for folding sheets from said image-forming apparatus; and said sheet folding apparatus is furnished with the configuration set forth in claim 1.

5. The image-forming system according to claim 4, further comprising an inserter, said inserter having a tray for holding sheets in place, and separating means for separating and feeding out one-by-one sheets on said tray; wherein the image-forming system is configured to feed selectively to said folding process path sheets on said tray with sheets from said image-forming apparatus.

6. A sheet folding apparatus comprising:

a folding process unit for folding sequentially delivered sheets into a predetermined form defining a crease orientation;

a folded sheet stacking unit for stacking and stowing folding-processed sheets from said folding process unit; and conveyance means, provided between, for cooperative operation with, said folding process unit and said folded sheet stacking unit, for conveying one folding-processed sheet at a time from said process unit into said folded sheet stacking unit, said conveyance means comprising an upstream, first conveyance means for conveying folding-processed sheets from said folding process unit in a direction approximately orthogonal to the crease orientation, and a downstream, second conveyance means including a tray member for bearing folding-processed sheets from said first conveyance means and configured to be shorter in its conveyance-direction length than the length of at least the maximum-size sheet in the crease orientation, and a shift means for transporting folding-processed sheets along the tray member in the crease orientation into said folded sheet stacking unit.

7. The sheet folding apparatus according to claim 6, wherein:

said sheet stacking unit is constituted by a stacker for loading/stowing sheets from said conveyance means; and between said first conveyance means and said tray member a first level-split for drop-accommodating sheets, and between said tray member and said stacker a second level-split for drop-accommodating sheets are respectively formed.

8. The sheet folding apparatus according to claim 6, further comprising:

a sheet discharge path running from a downstream side of said first conveyance means, for conveying further downstream sheets from said folding process unit;

a path switching member provided in the sheet discharge path for selectively guiding to the sheet discharge path or to said tray member sheets from said first conveyance means; and a guide member provided above the tray member, for guiding sheets from said path switching member onto said tray member; wherein said guide member is configured to be free to shift between a retracted position where it does not hinder the conveying of sheets in the sheet discharge path, and a guiding position for guiding sheets to said tray member.

9. The sheet folding apparatus according to claim 8, wherein:

an engagement slot into which said shift member is fit is provided in said tray member, extending along the sheet-crease orientation; and said guide member guides sheets to above said tray member in such a way that the leading edge of a sheet advancing into said tray member does not advance into the engagement slot.

10. A sheet folding apparatus comprising:

a folding process unit for folding sequentially delivered sheets into a predetermined form defining a crease orientation;

a folded sheet stacking unit for stacking and stowing folding-processed sheets from said folding process unit;

conveyance means, provided between, for cooperative operation with, said folding process unit and said folded sheet stacking unit, for conveying one folding-processed sheet at a time from said folding process unit into said folded sheet stacking unit, said conveyance means comprising an upstream, first conveyance means for conveying folding-processed sheets from said folding process unit in a direction approximately orthogonal to the crease orientation, and a downstream, second conveyance means including a tray member for bearing folding-processed sheets from said first conveyance means, and a shift member, provided so as to circulate around the front and back sides of the tray member along an engagement slot into which said shift member is fit, the engagement slot being formed in said tray member, extending along the sheet-crease orientation, said shift member for transporting folding-processed sheets along the tray member in the crease orientation into said folded sheet stacking unit, and being configured to be free to bob so that coming into contact with sheets on said sheet stacking unit in the course of the circulating of said shift member topples it;

a sheet discharge path running from a downstream side of said first conveyance means, for conveying further downstream sheets from said folding process unit;

a path switching member provided in the sheet discharge path for selectively guiding to the sheet discharge path or to said tray member sheets from said first conveyance means; and a guide member provided above the tray member, for guiding sheets from said path switching member onto said tray member, said guide member being configured to be free to shift between a retracted position where it does not hinder the conveying of sheets in the sheet discharge path, and a guiding position for guiding sheets to said tray member, said guide member therein guiding sheets to above said tray member in such a way that the leading edge of a sheet advancing into said tray member does not advance into the engagement slot.

11. The sheet folding apparatus according to claim 10, wherein:

said sheet stacking unit is constituted by a stacker for loading/stowing sheets from said conveyance means; and between said first conveyance means and said tray member a first level-split for drop-accommodating sheets, and between said tray member and said stacker a second level-split for drop-accommodating sheets are respectively formed.

12. The sheet folding apparatus according to claim 10, further comprising:

a sheet discharge path running from a downstream side of said first conveyance means, for conveying further downstream sheets from said folding process unit;

a path switching member provided in the sheet discharge path for selectively guiding to the sheet discharge path or to said tray member sheets from said first conveyance means; and a guide member provided above the tray member, for guiding sheets from said path switching member onto said tray member; wherein said guide member is configured to be free to shift between a retracted position where it does not hinder the conveying of sheets in the sheet discharge path, and a guiding position for guiding sheets to said tray member.

13. The sheet folding apparatus according to claim 12, wherein:

an engagement slot into which said shift member is fit is provided in said tray member, extending along the sheet-crease orientation; and said guide member guides sheets to above said tray member in such a way that the leading edge of a sheet advancing into said tray member does not advance into the engagement slot.

14. An image-forming system comprising:

an image forming apparatus for imaging onto sheets;

a sheet folding apparatus for folding sheets from said image-forming apparatus; and a finisher for stacking into a bundle and binding together sheets from said folding apparatus; wherein said sheet folding apparatus is provided with a sheet discharge path for conveying sheets from said image-forming apparatus to said finisher, and a folding process path for folding sheets from said image-forming apparatus; and said sheet folding apparatus is furnished with the configuration set forth in claim 10.

15. The image-forming system according to claim 14, further comprising an inserter, said inserter having a tray for holding sheets in place, and separating means for separating and feeding out one-by-one sheets on said tray; wherein the image-forming system is configured to feed selectively to said folding process path sheets on said tray with sheets from said image-forming apparatus.

* * * * *